US007571516B2

(12) United States Patent
Lueffe et al.

(10) Patent No.: US 7,571,516 B2
(45) Date of Patent: Aug. 11, 2009

(54) HINGE-PLATE ACCOMMODATION ELEMENT FOR ATTACHING A HINGE PLATE

(75) Inventors: Alfons Lueffe, Rheda-Wiedenbruck (DE); Uwe Sabrowski, Rheda-Wiedenbruck (DE)

(73) Assignee: Simonswerk, Gesellschaft mit beschränkter Haftung, Rheda-Wiedenbrück (DE)

( * ) Notice: Subject to any disclaimer, the term of this patent is extended or adjusted under 35 U.S.C. 154(b) by 46 days.

(21) Appl. No.: 11/497,128

(22) Filed: Aug. 1, 2006

(65) Prior Publication Data

US 2007/0028420 A1 Feb. 8, 2007

(30) Foreign Application Priority Data

Aug. 2, 2005 (DE) ..... 10 2005 036 212
Dec. 27, 2005 (EP) ..... 05028480

(51) Int. Cl.
*E05D 5/00* (2006.01)

(52) U.S. Cl. ..... 16/382; 16/235

(58) Field of Classification Search ..... 16/382, 16/235, 236, 240, 237, 238, 252, 242, 245
See application file for complete search history.

(56) References Cited

U.S. PATENT DOCUMENTS 4,438,597 A * 3/1984 Maggart ..... 49/501
4,535,503 A * 8/1985 Narita et al. ..... 16/382
4,553,286 A * 11/1985 Schwarz, II ..... 16/382
4,825,507 A * 5/1989 Killingstad ..... 16/241
5,339,493 A * 8/1994 MacIntyre ..... 16/238
5,611,113 A * 3/1997 Rock et al. ..... 16/246
5,694,665 A * 12/1997 Strickland et al. ..... 16/238
5,701,636 A * 12/1997 Jahnke ..... 16/238
5,713,105 A * 2/1998 Toomey ..... 16/245
5,755,011 A * 5/1998 Green et al. ..... 16/238
5,799,370 A * 9/1998 Davidian et al. ..... 16/236
5,938,239 A * 8/1999 Baumann et al. ..... 280/777
6,049,946 A * 4/2000 Cress et al. ..... 16/240
6,481,055 B2 * 11/2002 Cheng ..... 16/252
6,484,363 B1 * 11/2002 Chung ..... 16/242
6,516,494 B2 * 2/2003 Nakamoto et al. ..... 16/271
6,698,062 B2 * 3/2004 Egger et al. ..... 16/242
6,715,181 B1 * 4/2004 Fries ..... 16/271
6,925,685 B2 * 8/2005 Chen ..... 16/332
6,976,290 B2 * 12/2005 Boyer et al. ..... 16/280
2001/0015033 A1 * 8/2001 Minami ..... 49/324
2002/0144377 A1 * 10/2002 Cheng ..... 16/252

(Continued)

FOREIGN PATENT DOCUMENTS

DE 43 07 067 9/1994

(Continued)

*Primary Examiner*—Victor Batson
*Assistant Examiner*—Matthew Sullivan
(74) *Attorney, Agent, or Firm*—Collard & Roe, P.C.

(57) ABSTRACT

A hinge plate accommodation element for attaching a hinge plate has a holder bracket that has a first shank for attachment on the frame side and an angled short shank, a bracing plate that is connected with the short shank of the holder bracket, so as to pivot, a pressure plate that is disposed on the bracing plate with binding screws, and can be adjusted relative to the bracing plate by means of activation of the binding screws, and adjusting screws that are inserted into bores of the holder bracket, so as to rotate, and engage into threaded bores of the bracing plate.

16 Claims, 7 Drawing Sheets

U.S. PATENT DOCUMENTS

2005/0019224 A1* 1/2005 Pechter et al. ..... 422/102

FOREIGN PATENT DOCUMENTS

DE 196 24 558 7/1997
DE 19832123 C1 * 1/2000
DE 199 20 366 4/2000
DE 202 10 049 3/2003

* cited by examiner 32
31
32
6
17
32
3'
10
38
19
33
11
36
6
11
3'
12
13
7
5
12
2
1
8

HINGE-PLATE ACCOMMODATION ELEMENT FOR ATTACHING A HINGE PLATE

BACKGROUND OF THE INVENTION

1. Field of the Invention

The invention relates to a hinge plate accommodation element for attaching a hinge plate. The hinge plate accommodation element has a clamping device that consists of a bracing plate and a pressure plate, in which device a hinge plate tab of the hinge plate is fixed in place. The clamping device is adjustable perpendicular to the plane of the door, in order to align the door wing relative to the door frame. The adjustment perpendicular to the plane of the door is referred to as depth adjustment. Furthermore, the clamping device is designed to permit a vertical adjustment of the hinge plate tab between the bracing plate and the pressure plate.

2. The Prior Art

A hinge plate accommodation element is described in DE 196 24 558 C1, which has a clamping device consisting of a bracing plate and a pressure plate, for a hinge plate tab of the hinge plate. The clamping device is disposed within a housing, which consists of sheet-metal parts welded to one another. Adjusting screws are mounted between a front and rear housing surface, so as to rotate, which screws pass through threaded bores of the bracing plate. The clamping device is adjustable along the adjusting screws in translatory manner, by means of activation of the adjusting screws.

A similar arrangement is described in German Patent No. DE 202 10 049 U1. The hinge plate accommodation element has a housing with a front plate and a rear plate. The front and rear plates are firmly connected with one another to produce a shape-stable part, by means of spacers. Adjusting spindles are disposed between the front plate and the rear plate, which spindles are mounted in bores of the front and rear plate and pass through threaded bores in the bracing plate. The clamping device is displaceable on the adjusting spindles in a translatory manner, by activating the adjusting spindles.

The known hinge plate accommodation elements are complicated in terms of design and production technology. Because of their housing, i.e. because of the carrier that consists of a front and rear plate, the dimensions of the hinge plate accommodation element are so great that it often cannot be used for narrow hollow profile frames.

SUMMARY OF THE INVENTION

It is therefore an object of the invention to provide a hinge plate accommodation element that consists of few individual parts and is structured with a simple design. The hinge plate accommodation element is particularly suitable for installation into narrow hollow profile frames. A height adjustment device can be integrated as well.

This object is accomplished by a hinge plate accommodation element for attaching a hinge plate, having:

a holder bracket that has a first shank for attachment on the frame side and an angled short shank, a bracing plate that is connected with the short shank of the holder bracket, so as to pivot, a pressure plate that is disposed on the bracing plate with binding screws, and can be adjusted relative to the bracing plate by activating the binding screws, and adjusting screws that are inserted into bores of the holder bracket, so as to rotate, and engage into threaded bores of the bracing plate.

With the hinge plate accommodation element according to the invention, the carrier, i.e. the housing, is replaced with a simple holder bracket, the first shank of which is attached to surfaces of a door frame. The holder bracket has a short shank that is angled away, with which the bracing plate is connected so as to pivot. The bracing plate can be pivoted or tilted relative to the holder bracket by activating the adjusting screws, which are inserted into bores of the holder bracket so as to rotate, and engage into threaded bores of the bracing plate. The position of a hinge plate tab clamped between the bracing plate and the pressure plate can be adjusted in the desired depth direction, in other words perpendicular to the surface expanse of the hinge plate tab, by the tilting movement. In this connection, the pivot axis for the tilting movement is situated in the connection region between the short shank of the holder bracket and the bracing plate.

In the case of the usual dimensions of a hinge plate accommodation element according to the invention, the distance between the pivot axis and the adjusting screws is clearly less than the length of the hinge plate tab. Therefore, a great adjustment range of a hinge plate roller disposed on the hinge plate tab can be implemented by means of the lever effect of the hinge plate tab, even with a low structural height of the hinge plate accommodation element and a short adjustment path of the adjusting screws that results therefrom.

Preferably, the short shank of the holder bracket is angled approximately at a right angle. A reliable pivoting connection between the holder bracket and bracing plate can be implemented in that the short shank of the holder bracket has slot-shaped recesses into which holder tongues of the bracing plate engage. In order to hold the holder tongues of the bracing plate in the slot-like recesses even when the adjusting screws are removed, in the case of such an embodiment, the holder tongues can be deformed during production of the hinge plate accommodation element, after their first insertion into the recesses.

Preferably, deformable spacers are provided between the holder bracket and the bracing plate and, in practical manner, also between the bracing plate and the pressure plate. The first-time assembly of the hinge plate accommodation element as well as the introduction of a hinge plate tab into the clamping device consisting of the bracing plate and pressure plate is facilitated by the spacers. The spacing elements can consist of springs or elastic sleeves that surround the shaft of the adjusting screws or the shaft of the binding screws, respectively.

In a preferred embodiment of the invention, in the case of the bracing plate, a bow-shaped depression is provided in the region of the clamping plate, i.e., where the hinge plate tab is fixed in place in the accommodation element. Furthermore, the first shank is provided with a recess in the region of the clamping plate, which recess is longer and wider than the pressure plate. The free space created by the recess can be utilized for the adjustment path of the clamping device consisting of bracing plate and pressure plate. The arrangement described contributes to space-saving construction of the hinge plate accommodation element.

The hinge plate accommodation element as described is particularly suitable for attaching a hinge plate to a hollow frame profile. The first shank of the holder bracket is attached to the inner surface of the hollow frame profile. The adjusting screws have screw heads for being supported on the hollow frame profile. The screw heads are disposed in a depression of the holder bracket and preferably have a flat, broad head. The adjusting screws are accessible from the outside through a bore, the diameter of which is less than the diameter of the screw head, and can be activated using a screwdriver.

If necessary, an intermediate sheet-metal piece can be provided between the screw heads of the adjusting screws and the inner surface of the hollow frame profile, which piece is not connected with the holder bracket in the unassembled state of the hinge plate accommodation element. Such an intermediate sheet-metal piece can serve, for example in the case of a hollow frame profile made of plastic, to uniformly distribute the force exerted by the screw heads of the adjusting screws over a larger area of the hollow frame profile.

The hinge plate accommodation element as described can furthermore be used for attaching a hinge plate to an upright standing pillar or a casing frame. In this connection, the holder bracket is inserted into a milled-out section of an upright standing pillar or a casing frame. The hinge plate accommodation element has a bracket-shaped cover plate as an additional part, to cover the holder bracket. The holder bracket and the cover plate are provided with passage bores that align with one another, for attachment to the frame. The adjusting screws for adjusting the bracing plate have screw heads that are disposed in a depression of the holder bracket, so as to rotate, and support themselves on the cover plate.

According to a preferred embodiment of the invention, the bracing plate of the hinge plate accommodation element intended for upright standing pillars and casing frames has a bow-shaped elevation in the region of the pressure plate. It is practical if the holder bracket is provided with a recess in the region of the bow-shaped elevation, which is longer and wider than the bow-shaped elevation. The free space created by the recess can be utilized for the adjustment path of the clamping device consisting of bracing plate and pressure plate.

A height adjustment device can be integrated into the hinge plate accommodation element according to the invention. In this case, an adjustment excenter for vertical adjustment of the hinge plate is disposed between the bracing plate and the pressure plate, which excenter is mounted to rotate in bores of the bracing plate and the pressure plate. The hinge plate has a hinge plate tab that contains an excenter accommodation that surrounds the adjustment excenter and vertically oriented oblong holes, through which binding screws pass. The adjustment excenter can be activated from the outside, for example by means of an Allen wrench, a screwdriver, or the like. As soon as the desired position of the hinge plate tab has been adjusted, the hinge plate tab can be firmly clamped between pressure plate and bracing plate, by tightening the binding screws.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
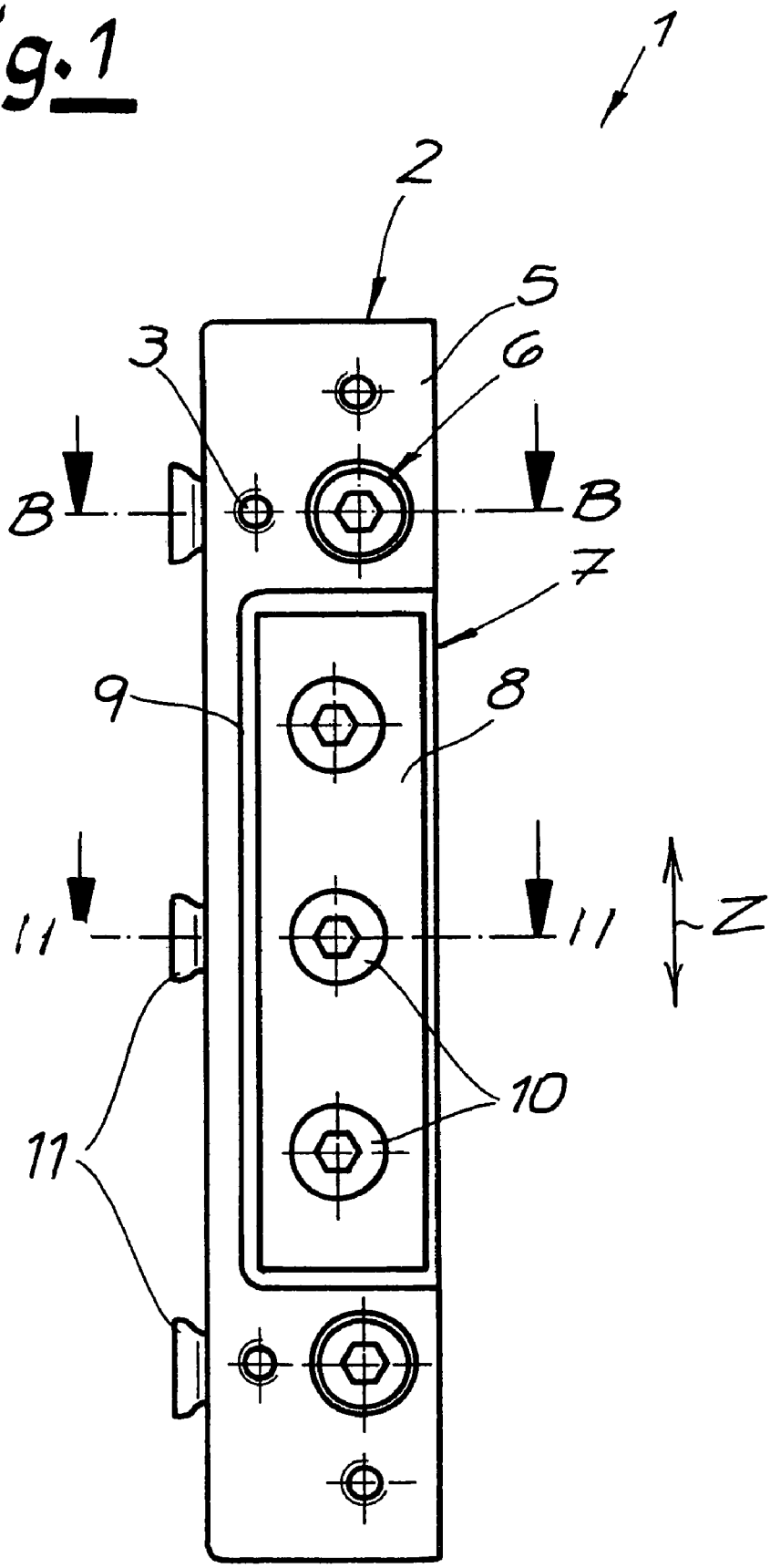
FIG. 1 shows a hinge plate accommodation element according to the invention.

Referring now in detail to the drawings, FIG. 1 shows a projection of a hinge plate accommodation element 1 according to the invention. A holder part configured as a holder bracket 2 has threaded bores 3 for attachment to the inner surface of a hollow frame profile 4. Adjusting screws 6 are disposed on a first shank 5 of holder bracket 2, which screws engage into threaded bores 3' of a bracing plate 7. A pressure plate 8 is inserted into a recess 9 of first shank 5, and adjustably attached to bracing plate 7 with binding screws 10. Bracing plate 7 has holder tongues 11, which engage into slot-shaped recesses 12 in a short shank 13 of holder bracket 2. Holder tongues 11 are deformed by squeezing, and are thereby permanently connected with holder bracket 2, so as to pivot, even after adjusting screws 6 are removed.

Figure 2:
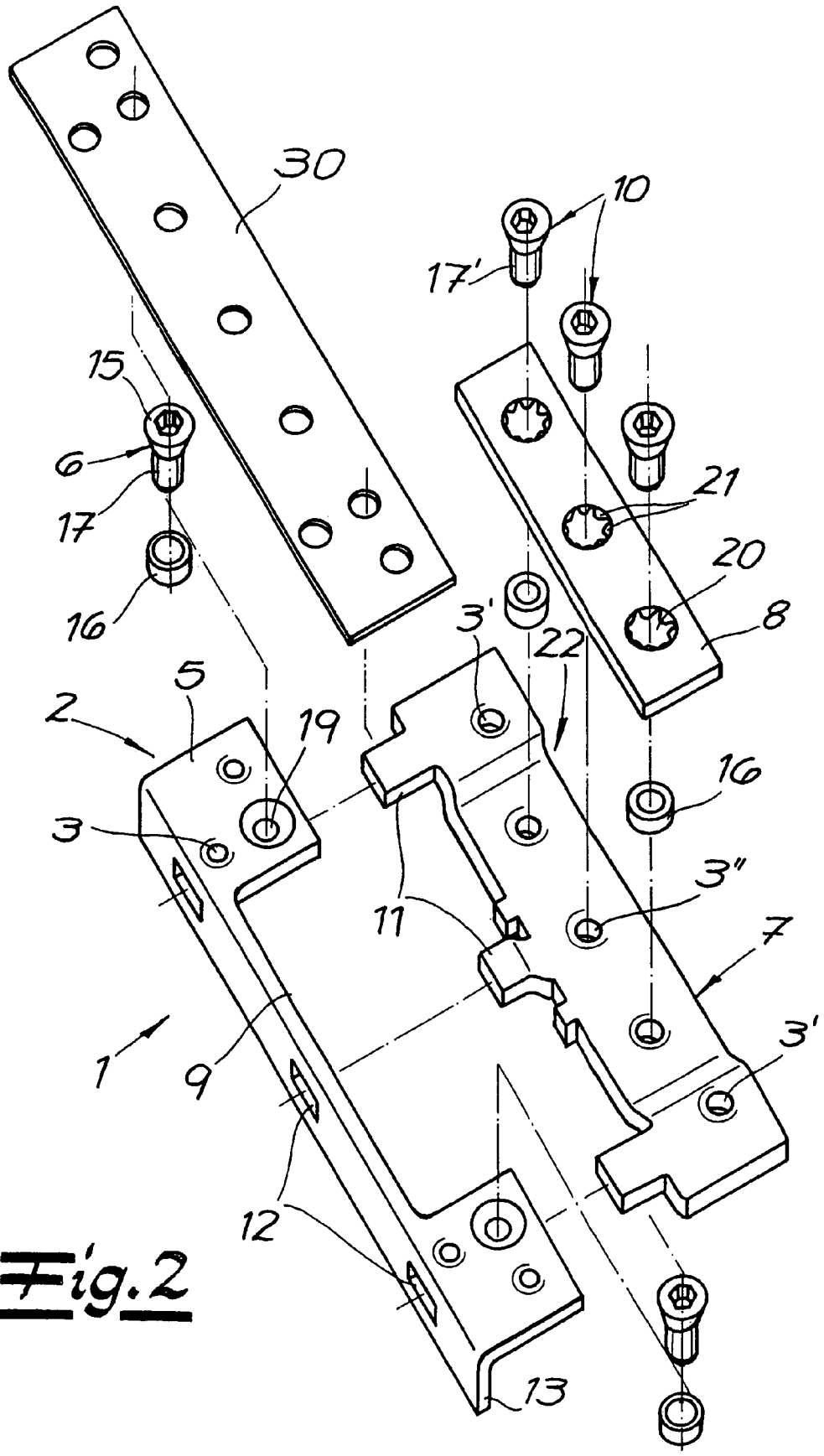
FIG. 2 shows the individual parts of the hinge plate accommodation element shown in FIG. 1, in an exploded view.

The parts of which a hinge plate accommodation element 1 according to the invention is composed are shown in FIG. 2. Deformable spacers 16 are provided between holder bracket 2 and bracing plate 7, as well as between bracing plate 7 and pressure plate 8. Deformable spacers 16 are configured as elastic plastic sleeves, and are disposed around threads 17, 17' of adjusting screws 6 and two binding screws 10. The spacers 16 allow problem-free multiple disassembly and assembly of hinge plate accommodation element 1 according to the invention in a hollow frame profile 4, and easy insertion of a hinge plate tab 18 between bracing plate 7 and pressure plate 8. Adjusting screws 6 are inserted into counter-sunk passage bores 19 of first shank 5 of holder bracket 2, each pass through a spacer 16, and engage into threaded bores 3' of bracing plate 7. Pressure plate 8 is adjustable relative to bracing plate 7 with binding screws 10 that pass through pressure plate 8 and engage into threaded bores 3" of bracing plate 7. Two binding screws 10 pass through spacers 16 that are disposed between pressure plate 8 and bracing plate 7. The bores 20 of pressure plate 8, into which the binding screws engage, are countersunk and have teeth 21 for securing tightened binding screws 10. Bracing plate 7 has a bow-shaped depression 22 in the region in which pressure plate 8 is disposed above bracing plate 7.

Figure 3A:
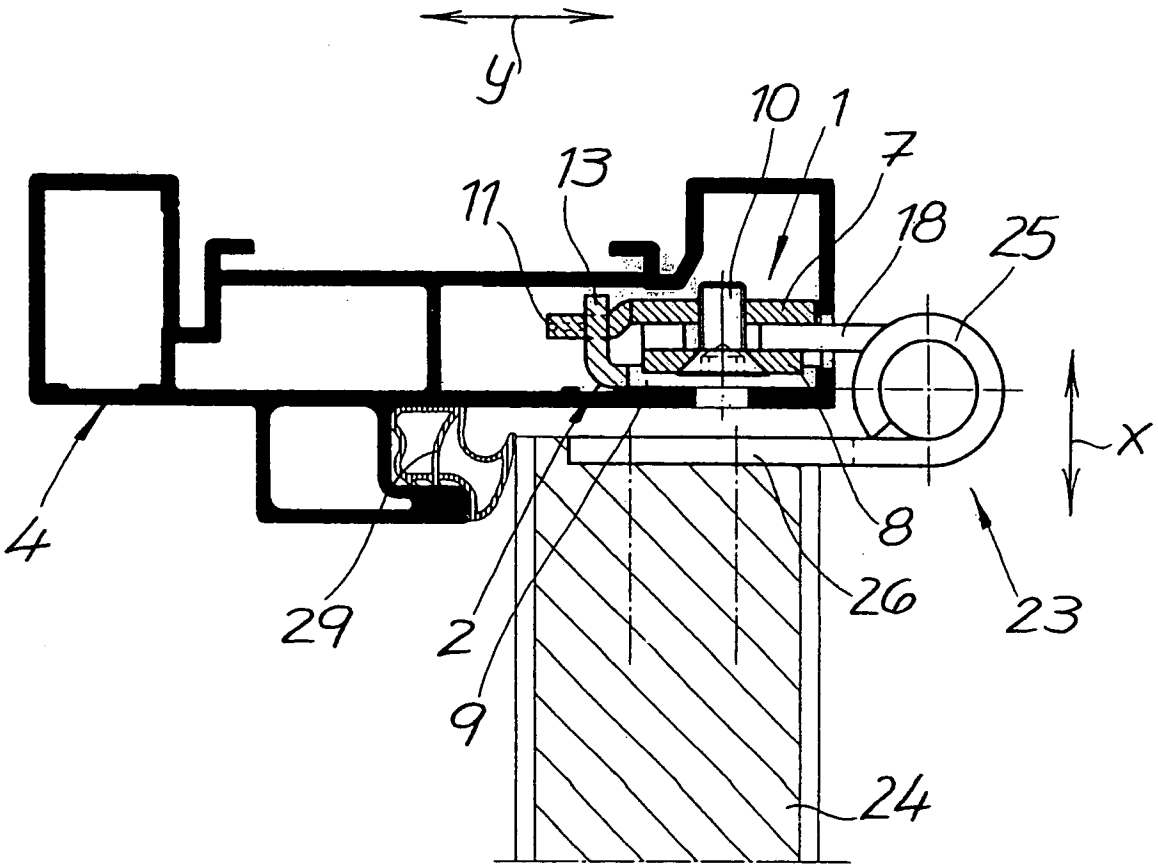
FIG. 3*a* shows the hinge plate accommodation element mounted in a hollow frame profile having a door wing attached to it by way of a hinge plate, specifically in a sectional representation in the section plane III-III from FIG. 1.
Figure 3B:
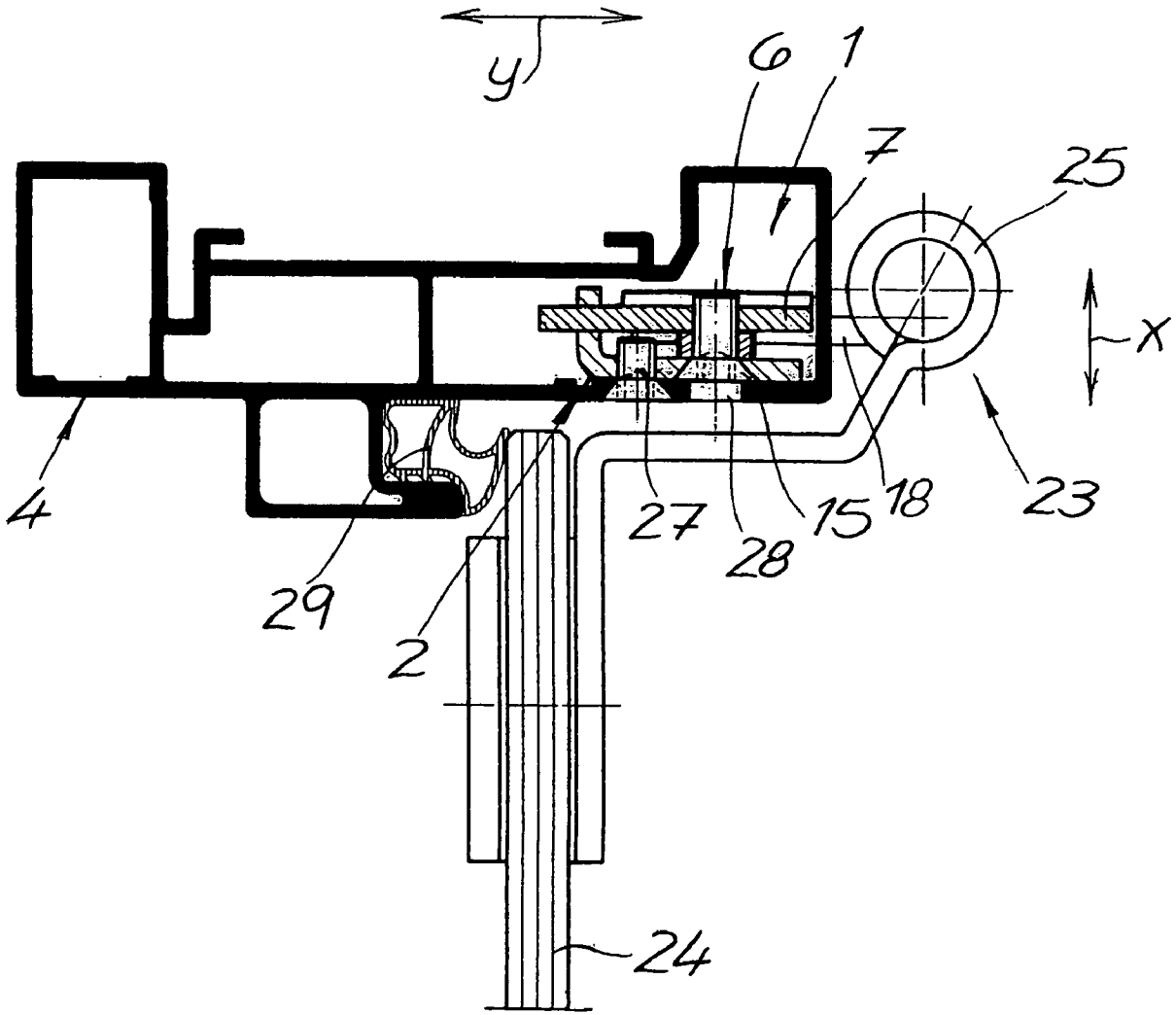
FIG. 3*b* shows the hinge plate accommodation element mounted in the hollow frame profile having a door wing attached to it by way of a hinge plate, specifically in a section in the section plane B-B from FIG. 1.

FIGS. 3*a* and 3*b* show hinge plate accommodation elements 1 mounted in hollow frame profiles 4, on which door wings 24 are attached hinge plates 23. Hinge plate tab 18 on the frame side is pushed into hinge plate accommodation element 1 with one end, and fixed in place between bracing plate 7 and pressure plate 8 with the binding screws 10. On the other side of the hinge plate tabs 18 on the frame side, a door wing 24 is connected with hollow frame profile 4 by way of a hinge plate roller 25 and a hinge plate part 26 on the door wing side, in each instance, whereby door wing 24 is attached to hollow frame profile 4 with at least two of hinge plates 23 shown. FIG. 3*a* shows a section along A-A, whereby a door wing 24 made of wood is attached to hollow frame profile 4 made of aluminum, with hinge plate 23.

FIG. 3*b* shows a section along the line B-B, whereby a door wing 24 made of glass is connected with hollow frame profile 4 made of plastic, by way of hinge plate 23. Hinge plate accommodation element 1 is fixed in place on the inside of hollow frame profile 4 with holding screws 27. Screw heads 15 of the adjusting screws 6 are supported on the inner surface of the hollow frame profile 4, and are accessible through openings 28 in hollow frame profile 4. Bracing plate 7 is tilted relative to the holder bracket 2 that is fixed in place in hollow frame profile 4, by means of rotating adjusting screw 6. The position of hinge plate roller 25 is adjusted essentially parallel to the orientation of closed door wing 24 (X). In addition, the horizontal position in thickness direction (Y) of door wing 24 and in vertical direction (Z) can be achieved by means of a displacement of the hinge plate tab 18 between bracing plate 7 and pressure plate 8. The adjustment of door wing 24 can be necessary in order to prevent wedging of door wing 24 and hollow frame profile, and in order to precisely adjust the contact position of the door wing 24. In this manner, a good seal of door wing 24 relative to a gasket 29 placed into hollow frame profile 4 can also be achieved.

An intermediate sheet-metal piece 30 can be provided between the screw heads of the adjusting screws and the inner surface of the hollow frame profile, which piece is shown in the exploded view of FIG. 2. In the case of a hollow frame profile made of plastic, the intermediate sheet-metal piece distributes the force exerted by the screw heads of adjusting screws 6 over a large area of hollow frame profile 4.

Figure 4:
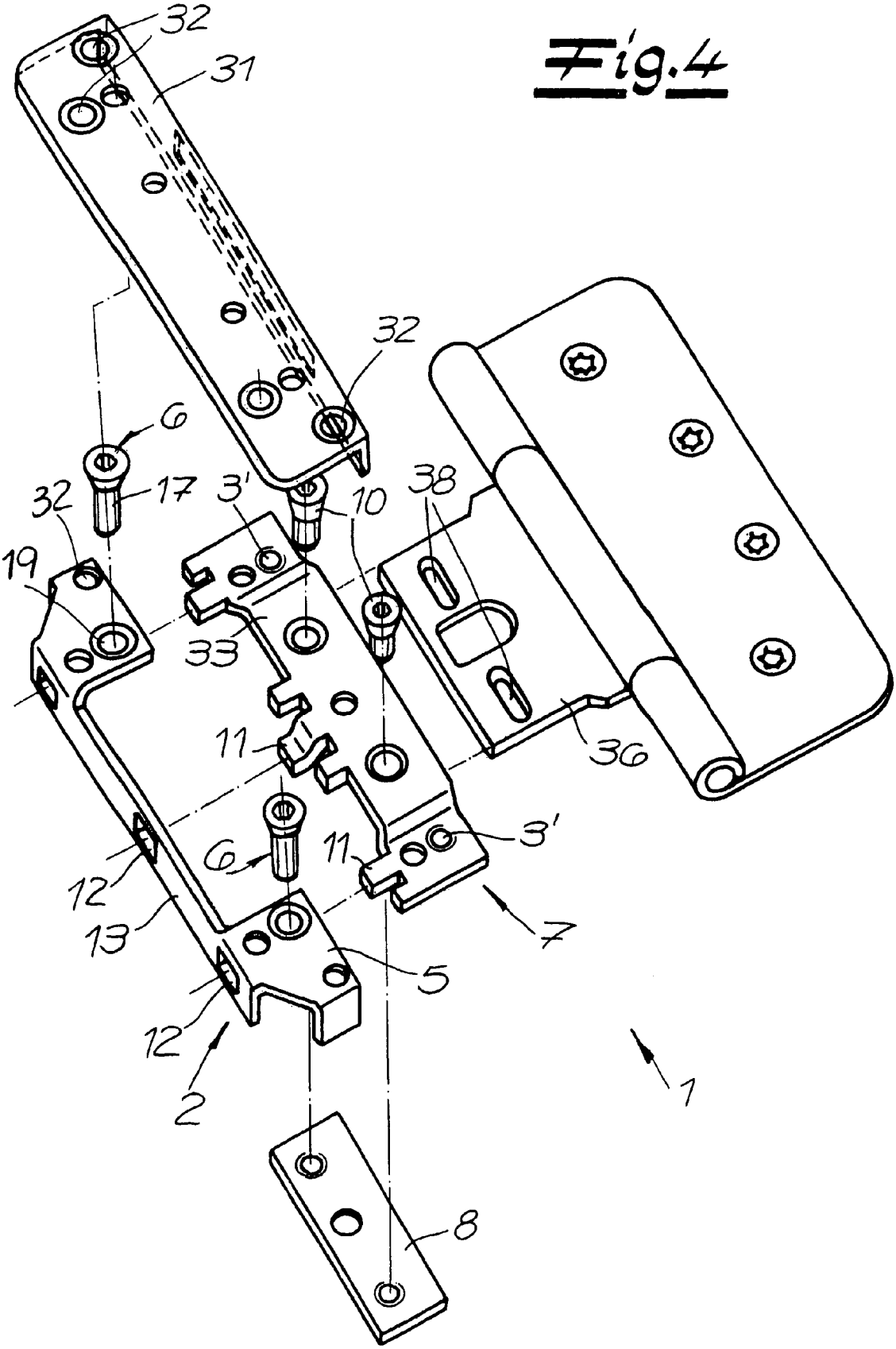
FIG. 4 shows the exploded view of a hinge plate accommodation element according to the invention, for use on an upright standing pillar or a casing frame.

The hinge plate accommodation element shown in FIG. 4 is intended for attachment to an upright standing pillar or a casing frame. The hinge plate accommodation element has the fundamental structure already described, and comprises a holder bracket 2, a bracing plate 7, a pressure plate 8, as well as adjusting screws 6, which are inserted into bores 19 of holder bracket 2 so as to rotate, and engage into threaded bores 3' of bracing plate 7. The bracing plate 7 is connected with short shank 13 of holder bracket 2, so as to pivot. The pressure plate 8 is disposed on bracing plate 7 with binding screws 10, and can be adjusted relative to the bracing plate 7 by activating the binding screws 10. In addition, a bracket-shaped cover plate 31 is provided, which covers holder bracket 2 that is inserted into a milled-out region in the upright standing pillar or casement frame. Holder bracket 2 and the cover plate 31 have passage bores 32 that align with one another, for attachment to the frame. Adjusting screws 6 for adjusting holder bracket 2 have screw heads that are disposed in a depression of the holder bracket, so as to rotate, and support themselves on the cover plate 31.

Bracing plate 7 has a bow-shaped elevation 33 in the region of pressure plate 8. Holder bracket 2 is provided with a recess in the region of this bow-shaped elevation 33, which is longer and wider than bow-shaped elevation 33. The free space created by the recess can be utilized for the adjustment path of the clamping device that consists of bracing plate 7 and pressure plate 8.

Figure 5:
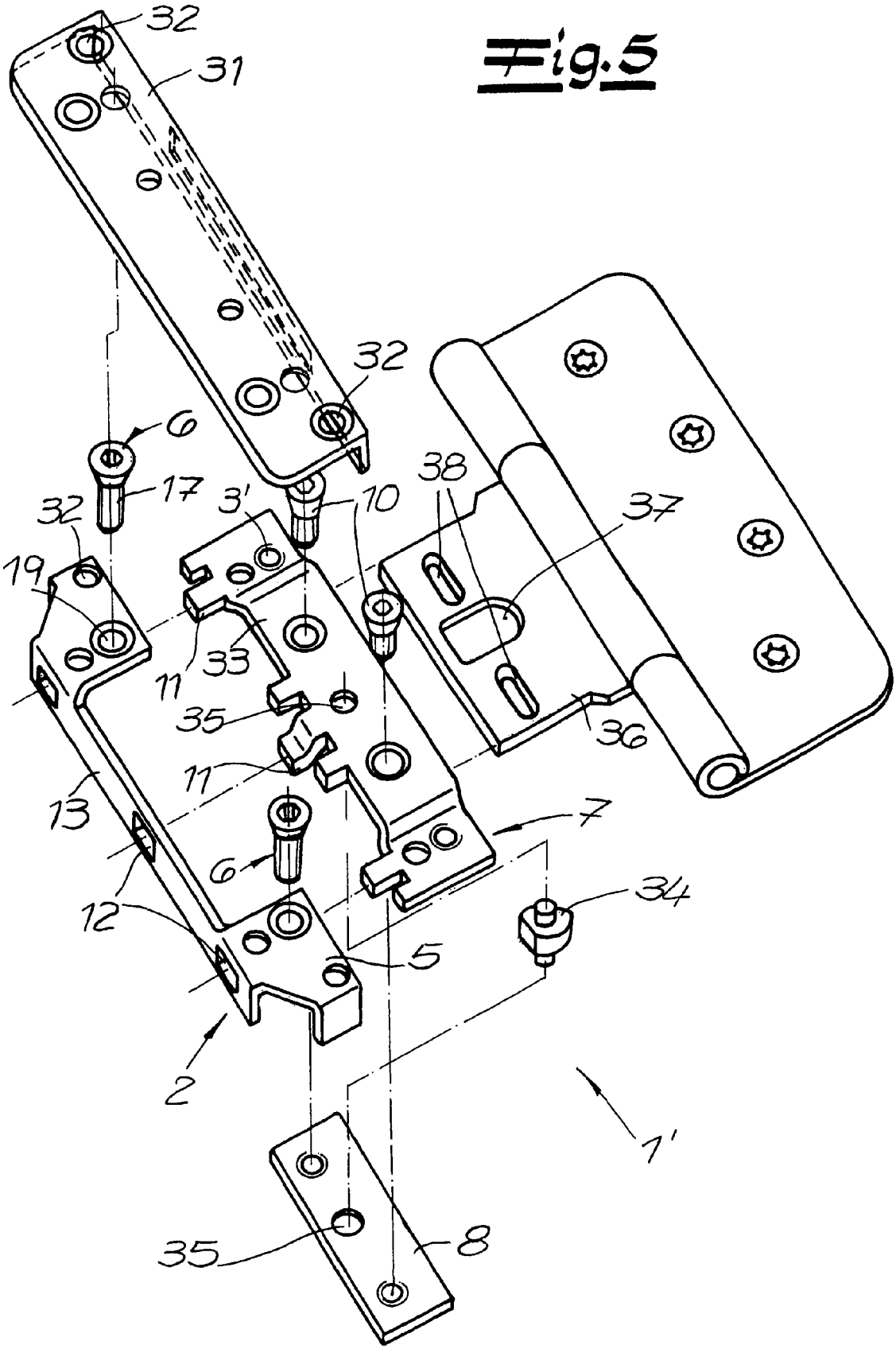
FIG. 5 shows the hinge plate accommodation element shown in FIG. 4 with an integrated height adjustment device, specifically also in an exploded view.

In the embodiment shown in FIG. 5, an adjustment device for vertical adjustment of the hinge plate tab is integrated into the hinge plate accommodation element. The adjustment device consists of an adjustment excenter 34 that is disposed between bracing plate 7 and pressure plate 8, and is mounted to rotate in bores 35 of bracing plate 7 and pressure plate 8. The hinge plate has a hinge plate tab 36 that contains an excenter accommodation 37 that surrounds adjustment excenter 34, and vertically oriented oblong holes 38. The binding screws 10 pass through the oblong holes 38. Adjustment excenter 34 acts on the hinge plate tab 36 that has been pushed in, and can be activated from the outside by way of a rotational movement by means of a tool, e.g. an Allen wrench. Once the desired position has been reached after activation of adjustment excenter 34, the binding screws 10 are tightened and hinge plate tab 36 is fixed in place between bracing plate 7 and pressure plate 8.

Figure 6:
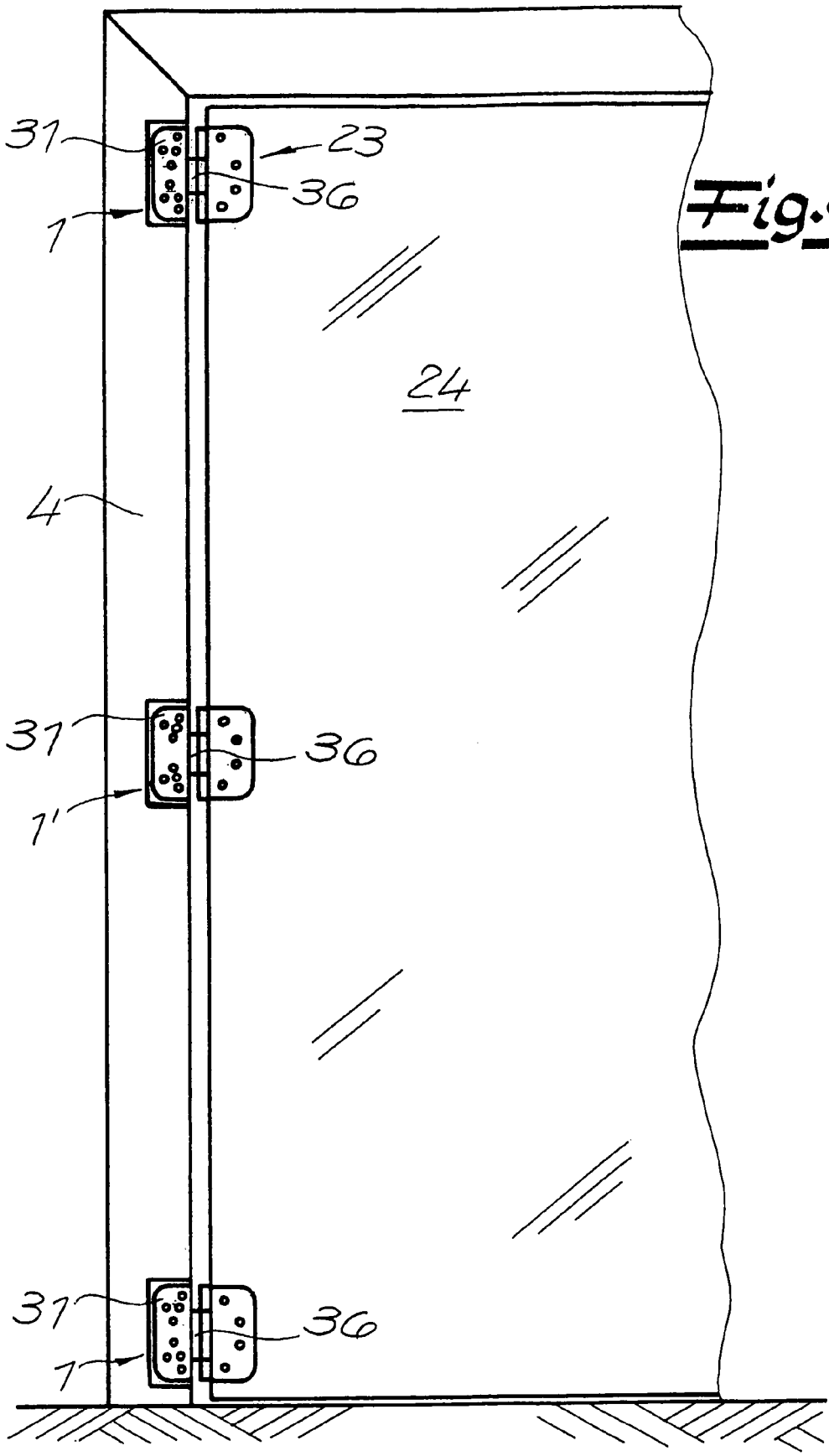
FIG. 6 shows a door that is held on a frame with the hinge plate accommodation elements shown in FIGS. 4 and 5.

FIG. 6 shows a door leaf disposed on a frame, which is held by means of three hinge plate accommodation elements 1, 1' configured according to the invention. The upper and lower hinge plate accommodation element 1 shown in the representation corresponds in its structure to the representation in FIG. 4. Hinge plate accommodation elements 1 allow a depth adjustment of the door leaf perpendicular to the plane of the door. The center hinge plate accommodation element 1' contains an integrated device for height adjustment, and corresponds to the representation in FIG. 5, whereby, however, the adjusting screws 6 are absent. The door leaf can be adjusted in depth by activating the adjusting screws 6 on the upper and lower hinge plate accommodation element 1, and in height by activating adjustment excenter 34 on center hinge plate accommodation element 1'. For depth adjustment, hinge plate tab 36 simply moves along.

Accordingly, while only a few embodiments of the present invention have been shown and described, it is obvious that many changes and modifications may be made thereunto without departing from the spirit and scope of the invention.

What is claimed is:

1. A hinge plate accommodation element for attaching a hinge plate, comprising:

a holder bracket having a first shank for attachment on a frame side and an angled short shank;

a bracing plate pivotally connected with the short shank of the holder bracket;

a pressure plate disposed on the bracing plate with binding screws, said pressure plate adapted to be adjusted relative to the bracing plate by activating the binding screws, wherein the bracing plate and the pressure plate act as a clamping device for fixing a hinge plate tab of the hinge plate; and adjusting screws that are inserted into bores of the holder bracket, so as to rotate, and engage into threaded bores of the bracing plate, wherein activating the adjusting screws adjusts a position of the the bracing plate relative to the holder bracket.

2. A hinge plate accommodation element according to claim 1, wherein the short shank of the holder bracket has slot-shaped recesses, and the bracing plate has holder tongues, said holder tongues engaging the slot-shaped recesses to connect the bracing plate to the holder bracket.

3. Hinge plate accommodation element according to claim 1, further comprising at least one deformable spacer between the holder bracket and the bracing plate.

4. A hinge plate accommodation element according to claim 3, wherein the spacer is a spring that surrounds a shaft of the adjusting screws.

5. A hinge plate accommodation element according to claim 3, wherein the spacer is an elastic sleeve that surrounds a shaft of the adjusting screws.

6. A hinge plate accommodation element according to claim 1, wherein the bracing plate has a bow-shaped depression in a region adjacent to the pressure plate.

7. A hinge plate accommodation element according to claim 1, wherein the first shank of the holder bracket has a recess in a region adjacent to the pressure plate, said recess being longer and wider than the pressure plate.

8. A hinge plate accommodation element for attaching a hinge plate to a hollow frame profile, comprising:

a holder bracket having a first shank for attachment on an inner surface of a hollow frame profile and an angled short shank;

a bracing plate pivotably connected with the short shank of the holder bracket;

a pressure plate disposed on the bracing plate with binding screws, said pressure plate being adjustable relative to the bracing plate by activating the binding screws, wherein the bracing plate and the pressure plate act as a clamping device for fixing a hinge plate tab of the hinge plate; and adjusting screws rotatably inserted into bores of the holder bracket, said adjusting screws engaging into threaded bores of the bracing plate and having screw heads for support on the hollow frame profile, wherein activating the adjusting screws adjusts a position of the bracing elate relative to the holder bracket.

9. A hinge plate accommodation element according to claim 8, wherein the short shank of the holder bracket has slot-shaped recesses and the bracing plate has holder tongues which engage into said slot-shaped recesses to connect the holder bracket with the bracing plate.

10. A hinge plate accommodation element according to claim 8, further comprising at least one deformable spacer between the holder bracket and the bracing plate.

11. A hinge plate accommodation element according to claim 8, wherein the bracing plate has a bow-shaped depression in the region of the pressure plate.

12. A hinge plate accommodation element according to claim 8, wherein the first shank of the holder bracket has a recess in a region adjacent to the pressure plate, said recess being longer and wider than the pressure plate.

13. A hinge plate accommodation element for attaching a hinge plate to an upright standing pillar or a casing frame, comprising:

a holder bracket having a first shank for attachment in a milled-out region of an upright standing pillar or a casing frame, and an angled short shank;

a bracing plate pivotably connected with the short shank of the holder bracket;

a pressure plate disposed on the bracing plate via binding screws, said pressure plate being adjustable relative to the bracing plate by activating the binding screws, wherein the bracing plate and the pressure plate act as a clamping device for fixing a hinge plate tab of the hinge plate;

adjusting screws that are rotatably inserted into bores of the holder bracket and engage into threaded bores of the bracing plate; and a bracket-shaped cover plate to cover the holder bracket, wherein the holder bracket and the cover plate have passage bores that align with one another, for attachment to the frame, and wherein the adjusting screws have screw heads that support themselves on the cover plate and wherein activating the adjusting screws adjusts a position of the bracing plate relative to the holder bracket.

14. A hinge plate accommodation element according to claim 13, wherein the bracing plate has a bow-shaped elevation in a region adjacent to the pressure plate.

15. A hinge plate accommodation element according to claim 14, wherein the holder bracket has a recess in a region adjacent to the bow-shaped elevation, said recess being longer and wider than the pressure plate.

16. A hinge plate accommodation element according to claim 13, further comprising:

an adjustment camming device for vertical adjustment of the hinge plate, said adjustment camming device being disposed between the bracing plate and the pressure plate, and being mounted to rotate in bores of the bracing plate and the pressure plate; and a hinge plate tab on the hinge plate, said hinge plate tab containing a camming device accommodation that surrounds the adjustment camming device, and vertically oriented oblong holes, wherein the binding screws pass through the oblong holes.

* * * * *